US009502788B2

(12) United States Patent
Mills et al.

(10) Patent No.: US 9,502,788 B2
(45) Date of Patent: Nov. 22, 2016

(54) CONNECTOR ASSEMBLY WITH A CONDUCTOR ASSEMBLY PARTIALLY DISPOSED IN A BLOCK ASSEMBLY

(71) Applicant: Labinal, LLC, Denton, TX (US)

(72) Inventors: Patrick Wellington Mills, Bradenton, FL (US); Richard George Benshoff, Sarasota, FL (US); James Michael McCormick, Bradenton, FL (US)

(73) Assignee: LABINAL, LLC, Denton, TX (US)

( * ) Notice: Subject to any disclaimer, the term of this patent is extended or adjusted under 35 U.S.C. 154(b) by 0 days.

(21) Appl. No.: 14/763,977

(22) PCT Filed: Dec. 11, 2013

(86) PCT No.: PCT/US2013/074294

§ 371 (c)(1),
(2) Date: Jul. 28, 2015

(87) PCT Pub. No.: WO2014/120340

PCT Pub. Date: Aug. 7, 2014

(65) Prior Publication Data

US 2015/0372400 A1 Dec. 24, 2015

Related U.S. Application Data

(60) Provisional application No. 61/758,291, filed on Jan. 30, 2013.

(51) Int. Cl.
*H01R 9/22* (2006.01)
*H01R 4/30* (2006.01)
(Continued)

(52) U.S. Cl.
CPC *H01R 4/30* (2013.01); *H01R 4/18* (2013.01); *H01R 9/2491* (2013.01); *H01R 13/42* (2013.01); *H01R 13/56* (2013.01); *H01R 13/426* (2013.01); *H01R 13/5025* (2013.01);
(Continued)

(58) Field of Classification Search
CPC ..... H01R 24/00; H01R 33/00; H01R 4/14; H01R 4/30; H01R 13/26; H01R 13/658; H01R 23/02; H01R 23/725; H01R 23/7073; H01R 9/22; H01R 9/24; H01R 9/2416; H01R 9/2458; H01R 9/2491; H01R 13/514
USPC ..... 439/660, 712–717
See application file for complete search history.

(56) References Cited

U.S. PATENT DOCUMENTS 3,840,839 A 10/1974 Smaczny et al.
4,084,875 A * 4/1978 Yamamoto ..... H01R 13/629 340/687

(Continued)

OTHER PUBLICATIONS

International Search Report filed in PCT/US2013/074294 mailed Feb. 21, 2014.

*Primary Examiner* — Chandrika Prasad
(74) *Attorney, Agent, or Firm* — Rankin, Hill & Clark LLP

(57) ABSTRACT

A connector assembly includes a non-conductive block assembly defining a plurality of passages and a resilient wire support defining a plurality of passages. The resilient wire support is coupled to the block assembly with each resilient wire support passage aligned with one block assembly passage. A conductor unit includes a plurality of conductor assemblies. Each conductor assembly includes a first socket and a second socket, and each such conductor assembly is disposed partially in a block assembly passage.

15 Claims, 4 Drawing Sheets

(51) Int. Cl.

| | |
|---|---|
| ***H01R 9/24*** | (2006.01) |
| ***H01R 13/42*** | (2006.01) |
| ***H01R 13/56*** | (2006.01) |
| ***H01R 4/18*** | (2006.01) |
| *H01R 13/426* | (2006.01) |
| *H01R 13/502* | (2006.01) |
| *H01R 24/52* | (2011.01) |
| *H01R 31/06* | (2006.01) |
| *H01R 107/00* | (2006.01) |

(52) U.S. Cl.
CPC ..... *H01R 24/52* (2013.01); *H01R 31/06* (2013.01); *H01R 2107/00* (2013.01)

(56) References Cited

U.S. PATENT DOCUMENTS 4,090,764 A * 5/1978 Malsby ..... H01R 13/514 439/471
4,531,796 A 7/1985 Gansert et al.
4,775,324 A * 10/1988 Norden ..... H01R 9/2408 439/709
4,989,118 A * 1/1991 Sorenson ..... H02B 1/205 200/307
5,310,364 A * 5/1994 Hooper ..... H01R 31/08 439/206
6,176,747 B1 * 1/2001 Rowe ..... H01R 9/2491 439/701
6,739,919 B2 * 5/2004 Murakami ..... H01R 9/2416 439/594
7,862,389 B2 * 1/2011 Pizzi ..... H01R 4/28 439/709
9,276,334 B1 * 3/2016 Daily ..... H01R 4/4827
2013/0309910 A1 * 11/2013 Gulla ..... H01R 12/91 439/626
2014/0113503 A1 * 4/2014 Barber ..... H01R 9/2408 439/712

* cited by examiner

CONNECTOR ASSEMBLY WITH A CONDUCTOR ASSEMBLY PARTIALLY DISPOSED IN A BLOCK ASSEMBLY

CROSS-REFERENCE TO RELATED APPLICATION

This application claims priority from and claims the benefit of U.S. Provisional Patent Application Ser. No. 61/758,291, filed Jan. 30, 2013, which is incorporated by reference herein.

BACKGROUND OF THE INVENTION

Field of the Invention

The disclosed and claimed concept relates to electrical connectors and, more specifically to an electrical connector including socket electrical connections and a support for an attached conductor.

Background Information

Electrical connectors have many different configurations, each of which have a disadvantage. For example, a single conductor, such as but not limited to a wire, may include a lug (or plug) structured to be inserted to a socket. A connector in this configuration typically does not support the conductor and occupies a greater amount of space than a multiple pin connector. That is, each socket includes a mounting and other hardware that occupies space. Further, any lug that is smaller than the socket may be inserted in the socket. Thus, a conductor may be coupled to the wrong socket.

A multiple pin connector includes a body in which multiple conductors are mounted. The body may have an asymmetrical shape about at least one axis. The socket into which the body is inserted has a corresponding shape. In this configuration, the body may only be inserted into the socket in a proper orientation. Further, the body typically clips to the socket. A connector in this configuration, however, requires that all conductors that are coupled to the body be coupled to the socket at the same time. That is, one cannot selectively couple one of the conductors to the socket.

A harness connector includes a plurality of threaded posts, typically disposed on a non-conductive body or mounting. Because the posts are coupled to a single non-conductive mounting, a harness typically occupies less space than a number of individual sockets equivalent to the number of posts. Conductors (wires) include a coupling, typically an O-shaped or U-shaped bodies sized to fit about, or substantially about, the post. The conductors are secured to the posts by a nut or similar coupling. In this configuration, individual conductors may be selectively coupled to the harness and secured with a nut. A connector in this configuration typically does not support the conductor. Further, users tend to over torque the coupling and may damage the harness connector.

There is, therefore, a need for a connector that supports the attached conductor, allows for individual conductors to be coupled to the connector and that resists damage when the conductor is coupled to the connector. There is a further need for a connector that may be used with existing hardware.

SUMMARY OF THE INVENTION

These needs, and others, are met by at least one embodiment of the disclosed concept which provides a connector including a non-conductive block assembly, a resilient wire support, and a conductor unit. The non-conductive block assembly defines a plurality of passages. The resilient wire support defines a plurality of passages. The resilient wire support is coupled to the block assembly with each resilient wire support passage aligned with one block assembly passage. The conductor unit includes a plurality of conductor assemblies, each conductor assembly including a first socket and a second socket. Each conductor assembly disposed partially in a block assembly passage.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 2:
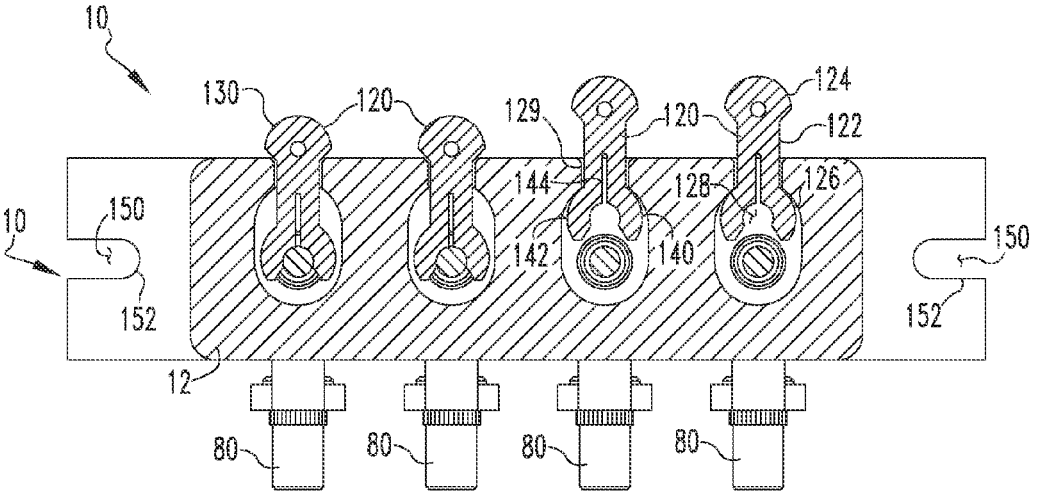
FIG. 2 is a top side view of a connector assembly.

As used herein, the singular form of "a," "an," and "the" include plural references unless the context clearly dictates otherwise. As used herein, the term "number," or "a number," shall mean one or an integer greater than one (i.e., a plurality).

As used herein, "coupled" means a link between two or more elements, whether direct or indirect, so long as a link occurs. An object resting on another object held in place only by gravity is not "coupled" to the lower object unless the upper object is otherwise maintained substantially in place. That is, for example, a book on a table is not coupled thereto, but a book glued to a table is coupled thereto.

As used herein, "directly coupled" means that two elements are directly in contact with each other.

As used herein, "fixedly coupled" or "fixed" means that two components are coupled so as to move as one while maintaining a constant orientation relative to each other. Similarly, two or more elements disposed in a "fixed relationship" means that two components maintain a substantially constant orientation relative to each other.

As used herein, the word "unitary" means a component is created as a single piece or unit. That is, a component that includes pieces that are created separately and then coupled together as a unit is not a "unitary" component or body.

As used herein, "associated" means that the identified components are related to each other, contact each other, and/or interact with each other. For example, an automobile has four tires and four hubs, each hub is "associated" with a specific tire.

As used herein, "engage," when used in reference to gears or other components having teeth, means that the teeth of the gears interface with each other and the rotation of one gear causes the other gear or other component to rotate/move as well. As used herein, "engage," when used in reference to components not having teeth means that the components are biased against each other.

Directional phrases used herein, such as, for example and without limitation, top, bottom, left, right, upper, lower, front, back, and derivatives thereof, relate to the orientation of the elements shown in the drawings and are not limiting upon the claims unless expressly recited therein.

As used herein, "correspond" indicates that two structural components are similar in size, shape or function. With reference to one component being inserted into another component or into an opening in the other component, "corresponding" means components are sized to engage or contact each other with a minimum amount of friction. Thus, an opening which corresponds to a member is sized slightly larger than the member so that the member can pass through the opening with a minimum amount of friction. This definition is modified if the two components are said to fit "snugly" together. In that situation, the difference between the size of the components is even smaller whereby the amount of friction increases. If one or more components are resilient, a "snugly corresponding" shape may include one component, e.g. the component defining the opening being smaller than the component inserted therein. Further, as used herein, "loosely correspond" means that a slot or opening is sized to be larger than an element disposed therein. This means that the increased size of the slot or opening is intentional and is more than a manufacturing tolerance.

As used herein, "at" means on or near.

Figure 4:
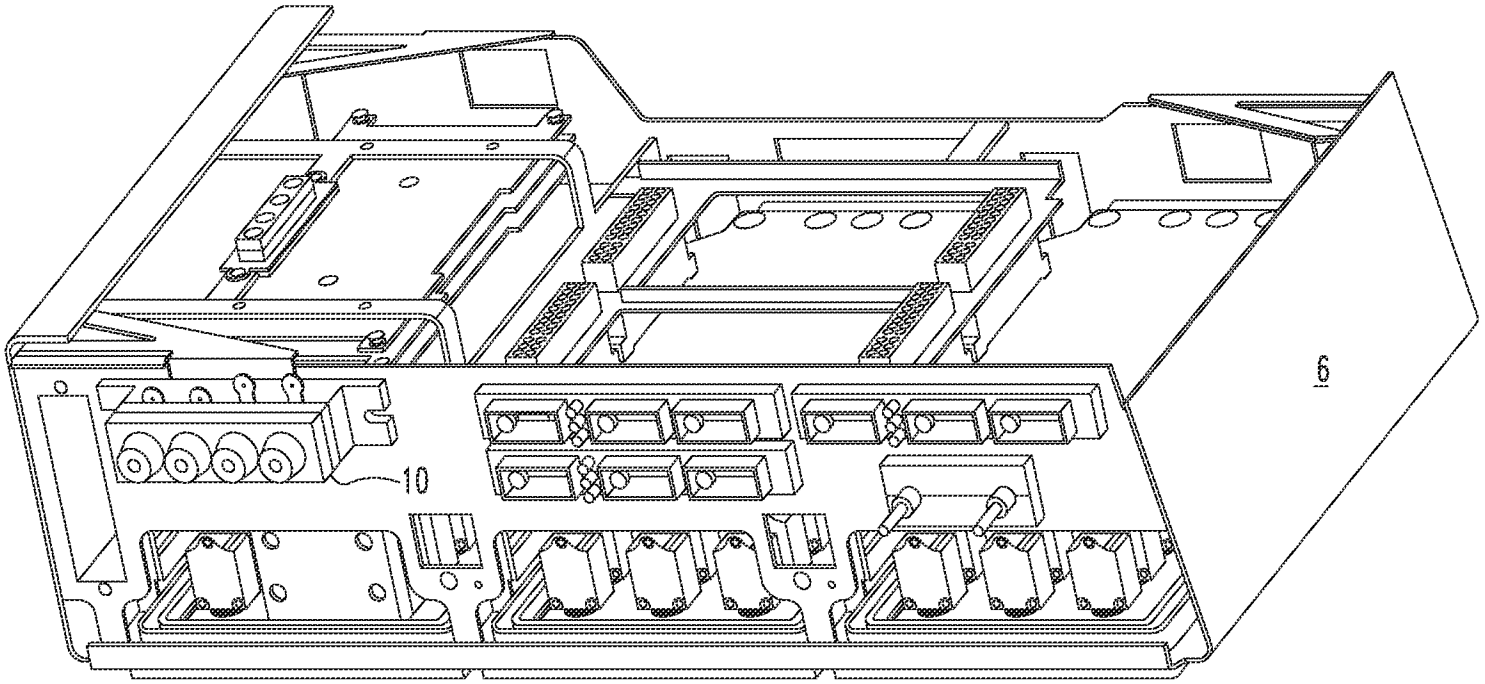
FIGS. 4 and 5 are isometric views of housing assembly for electronics.
Figure 5:
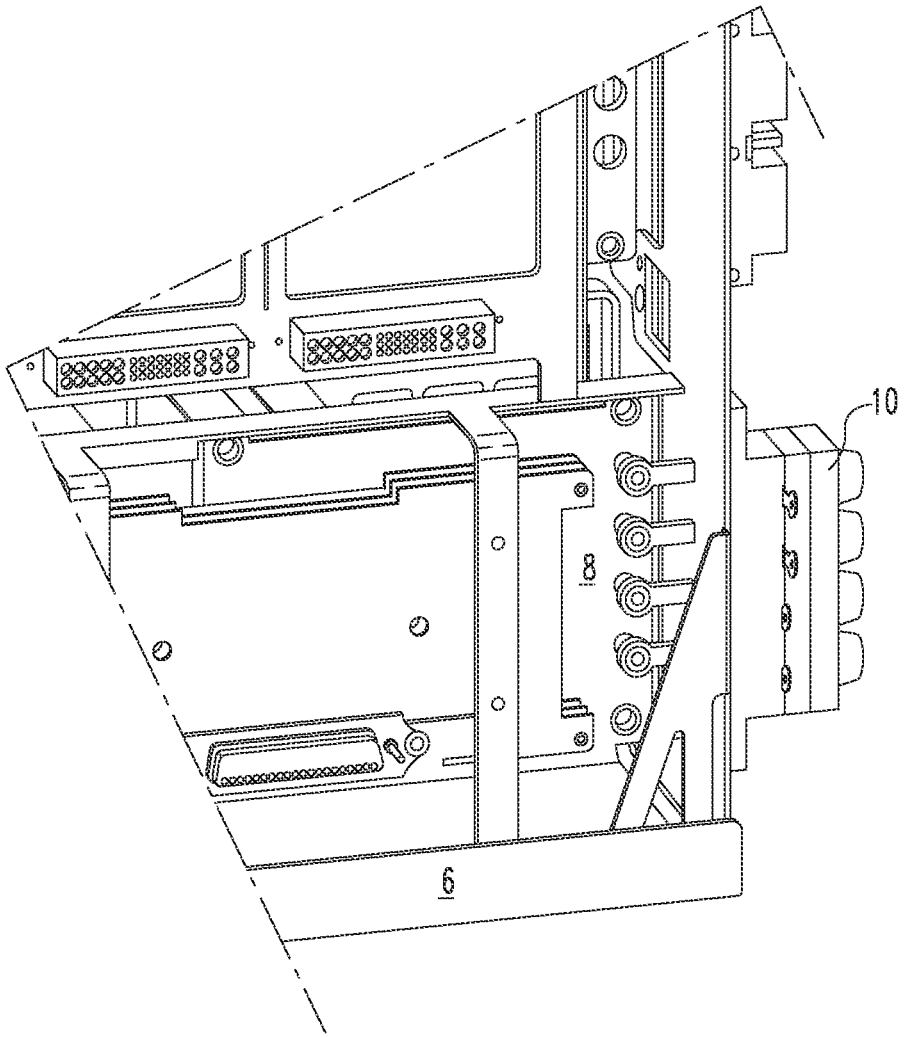

As shown in FIGS. 1-3B, a connector assembly 10 includes a non-conductive block assembly 12, a resilient wire support 14, and a conductor unit 16. The connector assembly 10 is structured to provide a plurality of electrical connections between a number of electrical devices. It is noted that by providing multiple connections, the connector assembly 10 solves the problem of individual connectors that occupy too much space. As shown, the connector assembly 10 includes four conductor assemblies 80 (discussed below). It is understood, however, that four conductor assemblies 80 are exemplary embodiments and the connector assembly 10 may include any number of conductor assemblies 80 so long as there are a plurality of conductor assemblies 80. As shown in FIGS. 4 and 5, the connector assembly 10 is coupled to, and in electrical communication with, a circuit board 8 (FIG. 5), which is coupled to, and in electrical communication with, other electrical components (not numbered). Further, the connector assembly 10 may be coupled to, and placed in electric communication with, electrical backplanes, electronics backplanes, or individual conductor pins/wires.

Figure 1:
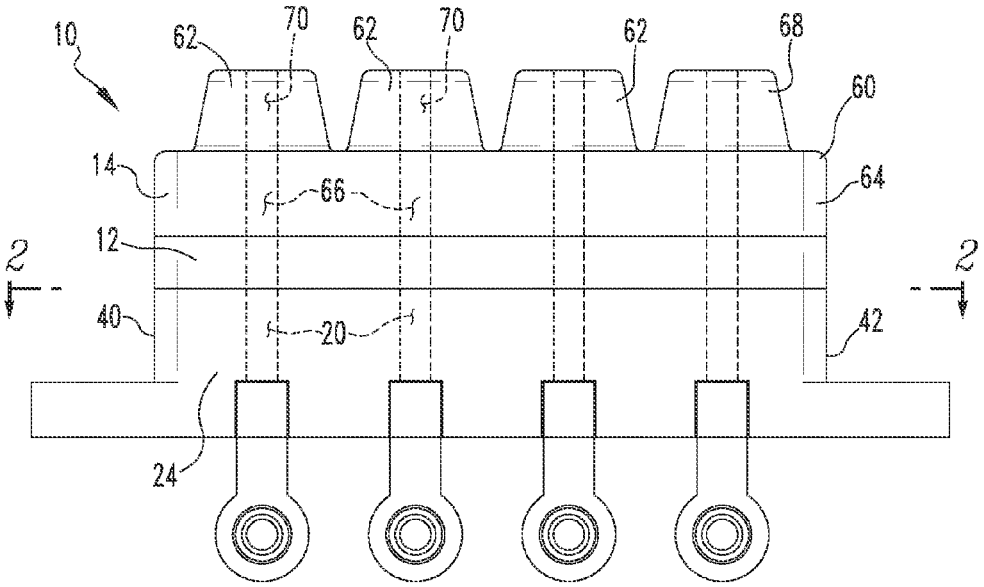
FIG. 1 is a back side view of a connector assembly.
Figure 3A:
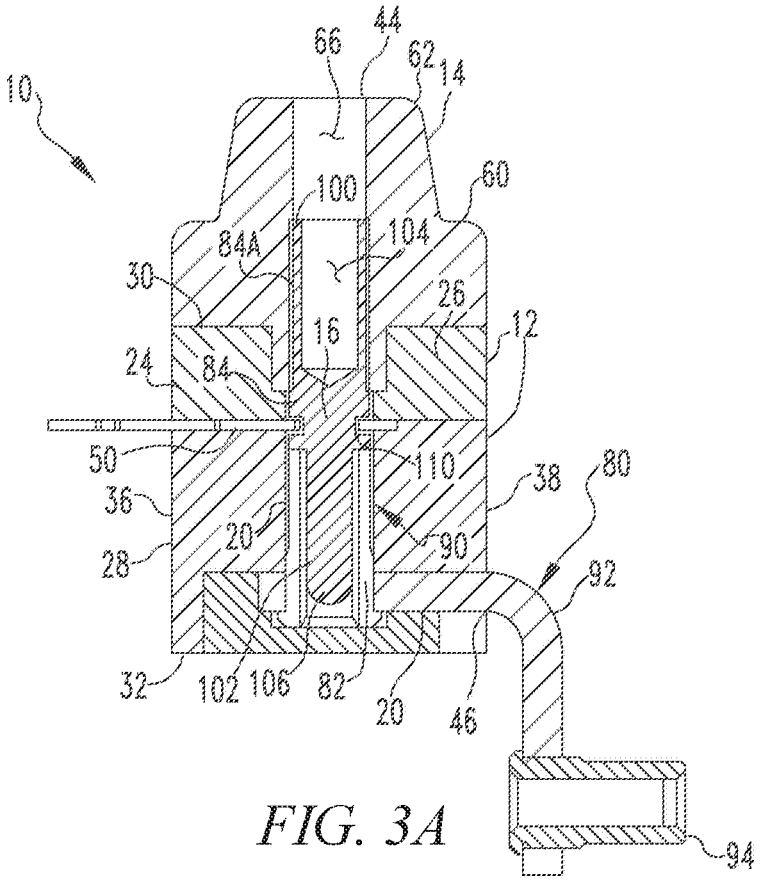
FIG. 3A is a cross-sectional view of a connector assembly and FIG. 3B is a cross-sectional view of a terminal pin.
Figure 3B:
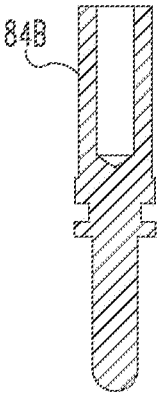

As shown in FIGS. 1-3B, the block assembly 12 is made from a non-conductive material and defines a plurality of passages 20. The block assembly 12 includes a body 24 that may be separate portions, an upper body portion 26 and a lower body portion 28. Each passage 20 is continuous through the two body portions 26, 28. The block assembly body 24 has a front side 30, a back side 32, an upper side 36, a lower side 38 (each shown in FIG. 3A) and two lateral sides 40, 42 (FIG. 1). In an exemplary embodiment, each block assembly passage 20 extends from the block assembly body front side 30, through substantially all of the block assembly body 24 to the block assembly body lower side 38. Thus, for each block assembly passage 20 there is a front opening 44 and a lower opening 46 in the block assembly body 24.

Between the upper body portion 26 and the lower body portion 28 are a plurality of clip passages 50. That is, there is one clip passage 50 per block assembly passage 20. Each clip passage 50 is in communication with a block assembly passage 20. That is, each clip passage 50 opens into a block assembly passage 20. In an exemplary embodiment, each clip passage 50 is thin and generally conforms to the maximum with and thickness of a clip 122.

The wire support 14 is structured to generally support the conductor (not shown), which is typically a conductive wire or a cable disposed in a non-conductive sleeve. The conductor, in an exemplary embodiment, includes an end terminal (not shown) which is an elongated lug structured to be inserted into a socket. As is known, a conductor and the associated end terminal are sized according to the current that passes through the conductor and the associated end terminal. Generally, the lower the current that passes through the conductor and the associated end terminal, the smaller the conductor and the associated end terminal. As is further known, the end terminal may be an elongated cylinder.

The wire support 14 includes a base member 60 and a plurality of support elements 62. The wire support 14 is, in an exemplary embodiment, a unitary, resilient, non-conductive body 64. The wire support base member 60 that defines a plurality of passages 66. Each wire support base member passage 66 is aligned and in communication with a block assembly passage 20. There is one support element 62 per wire support passage 66 and each support element 62 is associated with one wire support base member passage 66. That is, each support element 62 is a collar-like body 68 that defines a passage 70. Each support element body 68 is disposed about an end of a wire support base member passage 66. Each support element passage 70 is continuous with a wire support passage base member 66. That is, each support element passage 70 is aligned with a wire support base member passage 66. Thus, an element, such as, but not limited to, an end terminal, may be passed through support element passage 70, a wire support passage 66 and into a block assembly passage 20. In an exemplary embodiment, each support element body 68 is shaped as a tapered torus. Further, in an exemplary embodiment, each support element passage 70 is sized to correspond, or snuggly correspond, to the conductor extending therethrough.

The conductor unit 16 includes a plurality of conductor assemblies 80. The conductor assemblies 80 are substantially similar and only one will be described. A conductor assembly 80 is associated with, that is, disposed within, each block assembly passage 20. Thus, in the exemplary embodiment shown in the figures, there are four conductor assemblies 80. Each conductor assembly includes a socket assembly 82 and a terminal pin 84. Each socket assembly 82 includes a first conductive socket 90, a medial conductor 92, and a second conductive socket 94. The medial conductor 92 is coupled to, and in electrical communication with, the first conductive socket 90 and the second conductive socket 94. In an exemplary embodiment, the first conductive socket 90 and the second conductive socket 94 each have a generally circular cross-section. In an exemplary embodiment, the conductor assembly 80 is structured to carry a current of between about 1 amp and 400 amps. The first conductive socket 90 is disposed in a block assembly passage 20. The medial conductor 92 extends through the block assembly body lower opening 46. The second conductive socket 94 is disposed external to the block assembly 12.

The terminal pin 84 includes a first end 100 and a second end 102. The terminal pin first end 100 defines a socket 104. The terminal pin second end 102 is a lug 106. The terminal pin lug 106 is sized to correspond, or snuggly correspond, to the inner cross-sectional area of the first conductive socket 90. The inner diameter of the terminal pin socket 104 is sized to correspond, or snuggly correspond, to the size of the conductor, and more specifically the conductor terminal, to be disposed therein. When a terminal pin 84 is disposed in a first conductive socket 90 the terminal pin 84 is in electrical communication with the first conductive socket 90.

It is noted that the terminal pins 84 are removable, as described below, and as such, there may be more than one size of terminal pin 84 selectively coupled to a first conductive socket 90. That is, for example, there may be a first terminal pin 84A (FIG. 3A) having a terminal pin socket 104 sized to correspond to a first conductor and a second terminal pin 84B (FIG. 3B) having a terminal pin socket 104 sized to correspond to a second conductor, wherein the first and second conductors are different sizes. On each of the first and second terminal pins 84A, 84B, the lug 106 is sized to correspond, or snuggly correspond, to the inner cross-sectional area of the first conductive socket 90. Thus, a user may selectively install one of the first and second terminal pins 84A, 84B in the connector assembly 10 depending upon the desired use of the connector assembly 10. It is understood that there may be many different sized terminal pins 84A, 84B . . . 84N.

Each terminal pin 84 further includes a crimped portion 110. The terminal pin crimped portion 110 is a portion having a reduced outer cross-sectional area. In an exemplary embodiment, the terminal pin crimped portion 110 is disposed on the solid terminal pin lug 106. In an exemplary embodiment, the terminal pin crimped portion 110 is thin, i.e. the terminal pin crimped portion 110 has a limited axial dimension. The terminal pin crimped portion 110 has substantially the same dimensions regardless of the size of the terminal pin socket 104.

The block assembly 12 includes a plurality of clips 120 as well as the clip passages 50, described above. There is one clip 120 for each block assembly passage 20. Each clip 120 includes an elongated body 122 having a first end 124 and a second end 126. Each clip body second end 126 includes a recess 128. Each clip recess 128 is sized to correspond to a terminal pin crimped portion 110. Each clip body second end 126 disposed in a clip passage 50 with the clip recess 128 disposed substantially about a terminal pin crimped portion 110. In this configuration, the clip 120 substantially resists axial movement of the terminal pin 84 in the block assembly passage 20.

More specifically, each clip body first end 124 defines a grip 130. As shown, each grip 130 is a circular portion that may be gripped between a user's thumb and forefinger. Each clip body second end 126 includes two opposed arcuate members 140, 142. As used herein, "opposed," in reference to the arcuate members 140, 142, means that the members are generally mirror images of each other. In an exemplary embodiment, each clip body second end arcuate member 140, 142 extends over an arc of between about 10 and 15 degrees, and in another exemplary embodiment, over an arc of about 13 degrees. The clip recess 128 is the space between the opposed clip body second end arcuate members 140, 142. A medial portion 129 of the clip 120 includes an elongated slot 144. The elongated slot allows the clip body second end arcuate members 140, 142 to flex away from each other.

As shown in FIG. 4, the block assembly 12 may be coupled to a housing assembly 6 for electronics. Thus, the block assembly 12 may include a mounting coupling 150. As shown, the mounting coupling 150 includes a pair of slots 152 through which a fastener may be installed. When the block assembly 12 is coupled, and more specifically fixed, to a housing assembly 6, stress created by movement of the conductors will be generally absorbed by the support elements 62.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A connector assembly comprising:

a non-conductive block assembly defining a plurality of block assembly passages;

a resilient wire support defining a plurality of resilient wire support passages;

said resilient wire support coupled to said block assembly with each said resilient wire support passage aligned with one of the block assembly passages;

a conductor unit including a plurality of conductor assemblies, each conductor assembly including a first socket and a second socket; and each said conductor assembly disposed partially in one of the block assembly passages.

2. The connector assembly of claim 1 wherein:

said wire support includes a base member and a plurality of support elements;

said wire support base member defining a plurality of wire support base member passages;

each said support element defining a support element passage; and each said support element disposed about one of the wire support base member passages, wherein each said support element passage is aligned with one of the wire support base member passages.

3. The connector assembly of claim 2 wherein each of the support elements include a body shaped as a tapered torus.

4. The connector assembly of claim 3 wherein:

each said conductor assembly includes a socket assembly;

each said socket assembly includes a first conductive socket, a medial conductor, and a second conductive socket, each said medial conductor coupled to, and in electrical communication with one of the first conductive sockets and one of the second conductive sockets;

each said first conductive socket disposed in one of the block assembly passages; and each said second conductive socket disposed external to said block assembly.

5. The connector assembly of claim 4 wherein:

each said conductor assembly includes a terminal pin;

each said terminal pin including a first end and a second end;

wherein each said terminal pin first end defines a socket;

wherein each said terminal pin second end is a lug; and each said terminal pin second end disposed in, and in electrical communication with, one of the first conductive sockets.

6. The connector assembly of claim 5 wherein:

each said terminal pin includes a crimped portion;

said block assembly including a plurality of clip passages, each said clip in communication with one of the block assembly passages;

said block assembly includes a plurality of clips;

each said clip including an elongated body having a first end and a second end;

each said clip body second end including a recess;

each said clip recess sized to correspond to said terminal pin crimped portion;

each said clip body second end disposed in one of the clip passages; and wherein each said clip recess is disposed substantially about one of the terminal pin crimped portions.

7. The connector assembly of claim 6 wherein each said clip body first end defines a grip.

8. The connector assembly of claim 7 wherein:

each said clip body second end includes two opposed arcuate members;

each said clip body second end arcuate member extending over an arc of between about 10 and 15 degrees; and wherein each said clip recess is a space between said opposed clip body second end arcuate members.

9. The connector assembly of claim 8 wherein each said clip body second end arcuate member extends over an arc of about 13 degrees; or wherein each said clip body is an independent body.

10. The connector assembly of claim 1 wherein said block assembly includes a mounting coupling.

11. The connector assembly of claim 1 wherein:

each said conductor assembly includes a socket assembly;

each said socket assembly includes a first conductive socket, a medial conductor, and a second conductive socket, each said medial conductor coupled to, and in electrical communication with, one of the first conductive sockets and one of the second conductive sockets;

each said first conductive socket disposed in one of the block assembly passages; and each said second conductive socket disposed external to said block assembly.

12. The connector assembly of claim 11 wherein:

each said conductor assembly includes a terminal pin;

each said terminal pin including a first end and a second end;

wherein each said terminal pin first end defines a socket;

wherein each said terminal pin second end is a lug; and each said terminal pin second end disposed in, and in electrical communication with, one of the first conductive sockets.

13. The connector assembly of claim 12 wherein:

each said terminal pin includes a crimped portion;

said block assembly including a plurality of clip passages, each said clip passage in communication with one of the block assembly passages;

said block assembly includes a plurality of clips;

each clip including an elongated body having a first end and a second end;

each said clip body second end including a recess;

each said clip recess sized to correspond to said terminal pin crimped portion;

each said clip body second end disposed in one of said clip passages; and wherein each said clip recess is disposed substantially about one of the terminal pin crimped portions.

14. The connector assembly of claim 13 wherein each said clip body first end defines a grip.

15. The connector assembly of claim 13 wherein:

each said clip body second end includes two opposed arcuate members;

each said clip body second end arcuate member extending over an arc of between about 10 and 15 degrees; and wherein each said clip recess is a space between said opposed clip body second end arcuate members.

* * * * *